US009782986B2

(12) United States Patent
Sakakibara

(10) Patent No.: US 9,782,986 B2
(45) Date of Patent: Oct. 10, 2017

(54) IMAGE FORMING APPARATUS AND COMPUTER PROGRAM PRODUCT

(75) Inventor: Shigetaka Sakakibara, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 452 days.

(21) Appl. No.: 13/423,675

(22) Filed: Mar. 19, 2012

(65) Prior Publication Data

US 2012/0236057 A1 Sep. 20, 2012

(30) Foreign Application Priority Data

Mar. 18, 2011 (JP) ..... 2011-061568

(51) Int. Cl.
*B41J 19/14* (2006.01)

(52) U.S. Cl.
CPC ..... *B41J 19/147* (2013.01)

(58) Field of Classification Search
CPC ..... B41J 19/147
USPC ..... 347/14
See application file for complete search history.

(56) References Cited

U.S. PATENT DOCUMENTS 4,528,576 A 7/1985 Koumura et al.
5,107,332 A * 4/1992 Chan ..... 358/518
6,412,938 B1 * 7/2002 Markham et al. ..... 347/100
6,488,356 B1 * 12/2002 Klassen ..... G06K 15/105 347/41
2001/0006392 A1 * 7/2001 Otsuki ..... 347/9
2002/0063750 A1 * 5/2002 Kanda et al. ..... 347/41

FOREIGN PATENT DOCUMENTS

EP 0 737 001 10/1996
EP 1 046 510 10/2000
EP 1 106 369 6/2001
EP 1 291 192 3/2003
EP 1 500 514 1/2005
(Continued)

OTHER PUBLICATIONS

English language abstract for H08-248964 corresponds to JP 3545082.

(Continued)

*Primary Examiner* — Manish S Shah
*Assistant Examiner* — Jeffrey C Morgan
(74) *Attorney, Agent, or Firm* — Harness, Dickey & Pierce, P.L.C.

(57) ABSTRACT

Print head for black material is arranged such that the black material is to be ejected later than cyan, magenta, and yellow materials on both of forward and backward strokes, and the print heads for the cyan, magenta, and yellow materials are arranged in tandem in a main-scanning direction. The first processing unit converts input image data into CMY image data and then performs black generation and undercolor removal on the CMY image data, to obtain CMYK image data. The second processing unit converts CMY image data excluding K image data from the CMYK image data into image data for use in printing in the backward direction. The on/off switching unit switches between causing and not causing the second processing unit to covert the CMY image data depending on which one of printing in the forward stroke and printing in the backward stroke is to be performed.

7 Claims, 13 Drawing Sheets

(56) References Cited

FOREIGN PATENT DOCUMENTS

| | | | |
|---|---|---|---|
| JP | 3054508 | A | 3/1991 |
| JP | 2001171154 | A | 6/2001 |
| JP | 2001-260423 | A | 9/2001 |
| JP | 2002-307672 | A | 10/2002 |
| JP | 3367963 | B2 | 11/2002 |
| JP | 2003-025614 | A | 1/2003 |
| JP | 2003266749 | A | 9/2003 |
| JP | 2004-066601 | A | 3/2004 |
| JP | 2004-106392 | A | 4/2004 |
| JP | 3545082 | B2 | 4/2004 |
| JP | 2006001099 | A | 1/2006 |
| JP | 2006110795 | A | 4/2006 |
| JP | 2006159701 | A | 6/2006 |
| JP | 4486280 | B2 | 4/2010 |

OTHER PUBLICATIONS

English langauge abstract for JP 2003-025613 corresponds to JP 4486280.
English language abstract for 05-278231 corresponds to JP 3367963.
European Search Report dated Jul. 26, 2012.

* cited by examiner

IMAGE FORMING APPARATUS AND COMPUTER PROGRAM PRODUCT

CROSS-REFERENCE TO RELATED APPLICATIONS

The present application claims priority to and incorporates by reference the entire contents of Japanese Patent Application No. 2011-061568 filed in Japan on Mar. 18, 2011.

BACKGROUND OF THE INVENTION

1. Field of the Invention

The present invention relates to image forming apparatuses and computer program products.

2. Description of the Related Art

Inkjet recording apparatuses have become widespread for personal use because of their inexpensive pricing and high image quality of printouts produced using special paper. Inkjet recording apparatuses have steadily come into widespread use also in offices as recording apparatuses capable of color printing.

Improving recording speed has been desired to achieve wider spread of inkjet recording apparatuses in offices. More specifically, a typical inkjet recording apparatus performs recording by ejecting ink onto a recording sheet from a print head, which is considerably small as compared with the recording sheet, that repeatedly runs across a surface of a recording sheet. This can be said to be a recording scheme that performs recording on a "line-by-line" basis. This scheme is considered to be less advantageous in terms of recording speed than laser printers and the like that perform recording on a per-page basis, or, put another way, on a "sheet-by-sheet" basis.

Under the circumstances, improvements have been made on inkjet recording apparatuses to resolve the disadvantage in terms of speed. Examples of the improvements include shortening a cycle period of ink ejection to thereby increase a scan speed, reducing the number of scans by increasing the size of a recording head or employing bi-directional recording, and increasing efficiency of a scan sequence by adopting minimum-scan control of scanning only portions where image data is to be recorded.

However, unlike laser printers, off-set printing, and the like that cause a coloring material to fix onto the surface of a sheet, inkjet recording apparatuses cause a coloring material to permeate into a sheet and then fix thereto. For this reason, a problem and/or restriction associated with a penetration process are inherent to inkjet recording apparatuses.

For example, inkjet recording apparatuses have a problem resulting from that ink sticking to a sheet at one spot earlier is likely to yield more intense color than ink sticking to the same spot later does. More specifically, an ink impacting order is generally reversed in a bi-directional printing mode that increases a print speed. However, this reversing can undesirably cause a thin, horizontal banding pattern to be formed because color of each scanning band printed by a forward stroke differs from that printed by a backward stroke, and hence result in degradation in image quality.

Techniques have been proposed as countermeasures against a color difference resulting from different ink impacting orders such as a color difference that develops during bi-directional recording (hereinafter, referred to as "bi-directional color difference"). One of the techniques is disclosed in Japanese Examined Patent Application Publication No. H03-545082. The technique disclosed in Japanese Examined Patent Application Publication No. H03-545082 prevents difference between colors recorded by a forward stroke and colors recorded by a backward stroke by causing color conversion process for forward stroke scanning to differ from that for backward stroke scanning.

However, the technique such as that disclosed in Japanese Examined Patent Application Publication No. H03-545082 that simply switches between a color conversion process for forward stroke scanning and that for backward stroke scanning disadvantageously requires additional cost to increase capacity of buffer memory or the like when it is necessary to hold image-processed data until printing is performed. This disadvantage becomes more serious in wide format inkjet recording apparatuses (wide format printers).

Therefore, there is a need for an image forming apparatus capable of outputting printouts in appropriate hue without sacrificing print speed and with reduced additional cost.

SUMMARY OF THE INVENTION

According to an embodiment, there is provided an image forming apparatus that includes print heads; a first color-conversion processing unit; a second color-conversion processing unit; and an on/off switching unit. The print heads eject ink droplets of a plurality of coloring materials from nozzles thereof onto a recording sheet conveyed by a conveying unit. The print head for a first coloring material among the plurality of coloring materials is arranged such that the first coloring material is to be ejected later than other coloring materials on each of a forward stroke and a backward stroke in bi-directional printing, and the print heads for the other coloring materials are arranged in tandem in a main-scanning direction. The first color-conversion processing unit converts input image data into first image data for the plurality of coloring materials for use by the print heads in printing in any one direction of the forward stroke and the backward stroke. The second color-conversion processing unit converts a part of the first image data into second image data for the other coloring materials for use in printing in a direction opposite from the one direction. The part of the first image data being obtained by excluding image data for the first coloring material from the first color image data. The on/off switching unit switches between causing and not causing the second color-conversion processing unit to covert the part of the first image data depending on which one of printing in the forward stroke and printing in the backward stroke is to be performed by the print heads.

According to another embodiment, there is provided a computer program product including a non-transitory computer-readable medium including programmed instructions. The instructions are executed by a computer. The computer transmits image data to an image forming apparatus. The image forming apparatus includes print heads that eject ink droplets of a plurality of coloring materials from nozzles thereof onto a recording sheet conveyed by a conveying unit. The print head for a first coloring material among the plurality of coloring materials is arranged such that the first coloring material is to be ejected later than other coloring materials on each of a forward stroke and a backward stroke in bi-directional printing, and the print heads for the other coloring materials are arranged in tandem in a main-scanning direction. The instructions, when executed by the computer, cause the computer to execute performing first color conversion of converting the image data received from the computer into first image data for the plurality of coloring materials for use by the print heads in printing in any one direction of the forward stroke and the backward stroke; performing second color conversion of converting a part of the first image data into second image data for the other coloring materials for use in printing in a direction opposite from the one direction, the part of the first image data being obtained by excluding image data for the first coloring material from the first image data; and switching between causing and not causing the second color conversion to be performed on the part of the first image data depending on which one of printing in the forward stroke and printing in the backward stroke is to be performed by the print heads.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

First Embodiment

Figure 1:
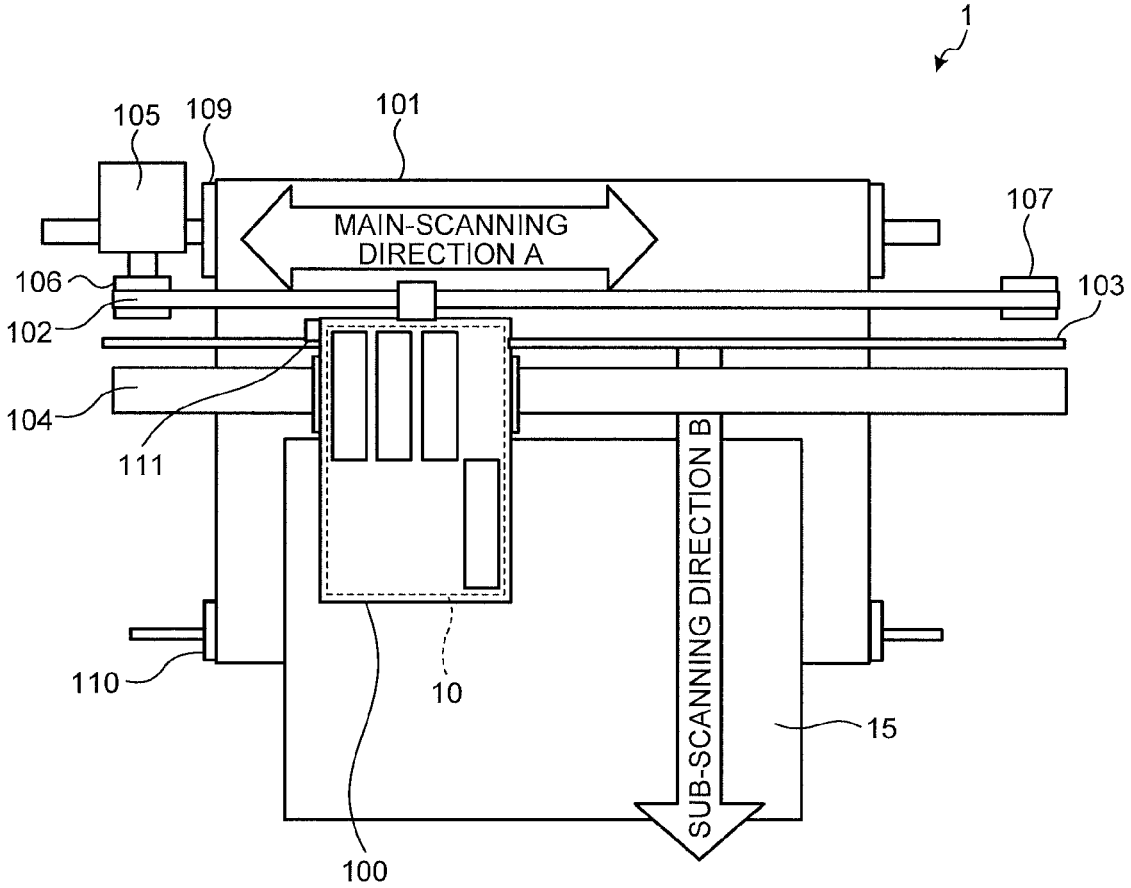
FIG. 1 is a diagram schematically illustrating a mechanism section of an inkjet recording apparatus according to a first embodiment of the present invention.

FIG. 1 is a diagram schematically illustrating a mechanism section of an inkjet recording apparatus 1 according to a first embodiment. FIG. 1 is a top view of the inkjet recording apparatus 1.

The inkjet recording apparatus 1 forms an image on a recording sheet 15 to output a printout. The recording sheet 15 is conveyed downward in FIG. 1. This direction is referred to as a sub-scanning direction B. The direction perpendicular to the sub-scanning direction is referred to as a main-scanning direction A. The inkjet recording apparatus 1 according to the first embodiment has a bi-directional printing mode. More specifically, a carriage 100 performs main scan in a forward direction from the right side to the left side in FIG. 1, and thereafter perform main scan in a backward direction from the left side to the right side.

The inkjet recording apparatus 1 includes the carriage 100, a sheet detection sensor 111, a conveying belt 101, a timing belt 102, an encoder scale 103, a guide rod 104, a main-scanning motor 105, a driving pulley 106, a driven pulley 107, a conveying roller 109, and a tension roller 110.

The guide rod 104 is laterally laid across a right side plate and a left side plate (not shown). The carriage 100 is held by the guide rod 104, and moves and sans in the main-scanning direction A by the main-scanning motor 105 via the timing belt 102 laid around the driving pulley 106 and the driven pulley 107.

The carriage 100 includes a head unit 10 that ejects ink droplets of colors of, for instance, yellow (Y), cyan (C), magenta (M), and black (B).

The head unit 10 of the inkjet recording apparatus 1 generates pressure for ejecting ink droplets by using, for instance, a piezoelectric actuator, a thermal actuator, a shape-memory alloy actuator, or an electrostatic actuator.

The encoder scale 103 in which slits are defined is situated along the main-scanning direction. The carriage 100 includes a photo-detector (encoder sensor) for detecting the slits to serve as a linear encoder that detects a position of the carriage 100 in the main-scanning direction A.

The sheet detection sensor 111 is provided on the carriage 100. The sheet detection sensor 111 detects a left end and a right end of a sheet when the carriage 100 is moved for scanning. The width of the sheet can be obtained by this detection. The sheet detection sensor 111 also detects a leading end of the sheet. By this detection, a position where the carriage 100 is to start image formation can be determined accurately.

The conveying belt 101 electrostatically attracts the recording sheet 15 and conveys the recording sheet 15 to a position facing print heads of the carriage 100. The conveying belt 101 is an endless belt supported on the conveying roller 109 and the tension roller 110. Hence, the conveying belt 101 revolves in the sub-scanning direction B and is electrostatically charged by an electrostatic charging roller (not shown).

The conveying belt 101 is a single-layer or a multiple-layer belt. When the conveying belt 101 is a single-layer belt, an entire layer is to be made of an insulating material because the conveying belt 101 comes into contact with the recording sheet 15 and the electrostatic charging roller (not shown). When the conveying belt 101 is a multiple-layer belt, a layer on a side where the conveying belt 101 comes into contact with the recording sheet 15 and the electrostatic charging roller is desirably made of an insulating material, while a side where the conveying belt 101 does not come into contact with the recording sheet 15 and the electrostatic charging roller is desirably a conductive layer.

As described above, the inkjet recording apparatus 1 causes the head unit 10 to eject ink droplets onto the recording sheet 15 while conveying the recording sheet 15 in the sub-scanning direction B and causing the head unit 10 to make frontward and backward stroke scan motions in the main-scanning direction A, thereby printing an image on the recording sheet 15.

Figure 2:
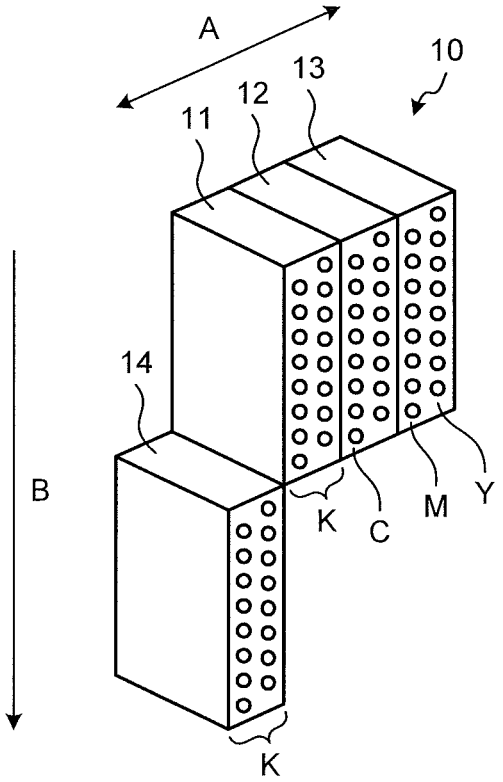
FIG. 2 is a diagram schematically illustrating an example configuration of a head unit to be mounted on the inkjet recording apparatus according to the first embodiment.

FIG. 2 is a diagram schematically illustrating an example configuration of the head unit 10 to be mounted on the inkjet recording apparatus 1 according to the first embodiment. As illustrated in FIG. 2, the head unit 10 includes print heads 11, 12, 13, and 14. The inkjet recording apparatus 1 performs recording by ejecting ink droplets onto a surface of the recording sheet 15 from the head unit 10 that is formed by combining the print heads 11, 12, 13, and 14 into one piece.

The head unit 10 ejects ink droplets from nozzles thereof onto the recording sheet 15 conveyed by the conveying belt 101. The head unit 10 is capable of ejecting four coloring materials (black, cyan, magenta, and yellow). In the head unit 10, the print head 14 for the black coloring material is arranged such that the black coloring material is ejected later than the other coloring materials (cyan, magenta, and yellow) on each of a forward stroke and a backward stroke during scanning. Furthermore, the print heads 12 and 13 capable of ejecting the other coloring materials (cyan, magenta, and yellow) and the print head 11 capable of ejecting the black coloring material are arranged in tandem in the main-scanning direction A.

The head unit 10 according to the first embodiment includes the plurality of print heads for the black coloring material. The print head 11 which is one of the print heads for the black coloring material and the print heads 12 and 13 for the other coloring materials (CMY) are arranged in tandem with one another in the main-scanning direction A. The print head 14 which is the other one of the print heads for the black coloring material is deviated from the print heads 12 and 13 by a distance corresponding to one print line so that ejection from the print head 14 is performed after the ejection from the print heads 12 and 13 for the other coloring materials and the ejection from one of the print head for black coloring material. The black coloring material is allocated to the two print heads, or, more specifically, the print heads 11 and 14 in this way. This doubles a region to be printed with black in one stroke as compared with a region to which each of the other coloring materials (CMY) is ejected in the one stroke. As a result, speed in monochrome printing can be increased.

Each of the print heads 11, 12, 13, and 14 is configured such that a plurality of ink ejection ports (nozzles) directed downward are arranged in the sub-scanning direction B that is perpendicular to the main-scanning direction A. The print heads may be separated on a color-by-color basis. Each of the print heads 11, 12, 13, and 14 includes two rows of the ink ejection ports (nozzles). The ink ejection ports (nozzles) are in a staggered arrangement such that the two rows are staggered apart by a distance corresponding to half a nozzle spacing. Accordingly, the print heads 11 and 14 each having the two rows for the black coloring material can double a print dot density compared with each of the other coloring materials. It also becomes possible to cause the black coloring material to be ejected onto the recording sheet 15 later than the coloring materials of the other colors in multiple-color printing by not using the print head 11 but using only the print head 14 for the black coloring material.

Figure 3:
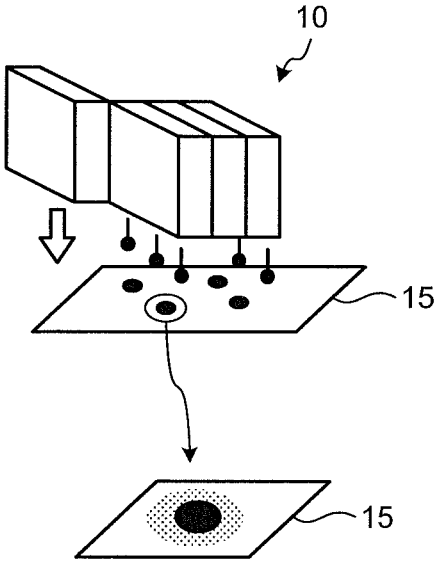
FIG. 3 is a conceptual diagram illustrating droplets ejected from the head unit mounted on the inkjet recording apparatus according to the first embodiment.

FIG. 3 is a conceptual diagram illustrating droplets ejected from the head unit 10. As illustrated in FIG. 3, each of the print heads 11, 12, 13, and 14 of the head unit 10 ejects ink onto the recording sheet 15 to bring about an image-recorded state.

Figure 4:
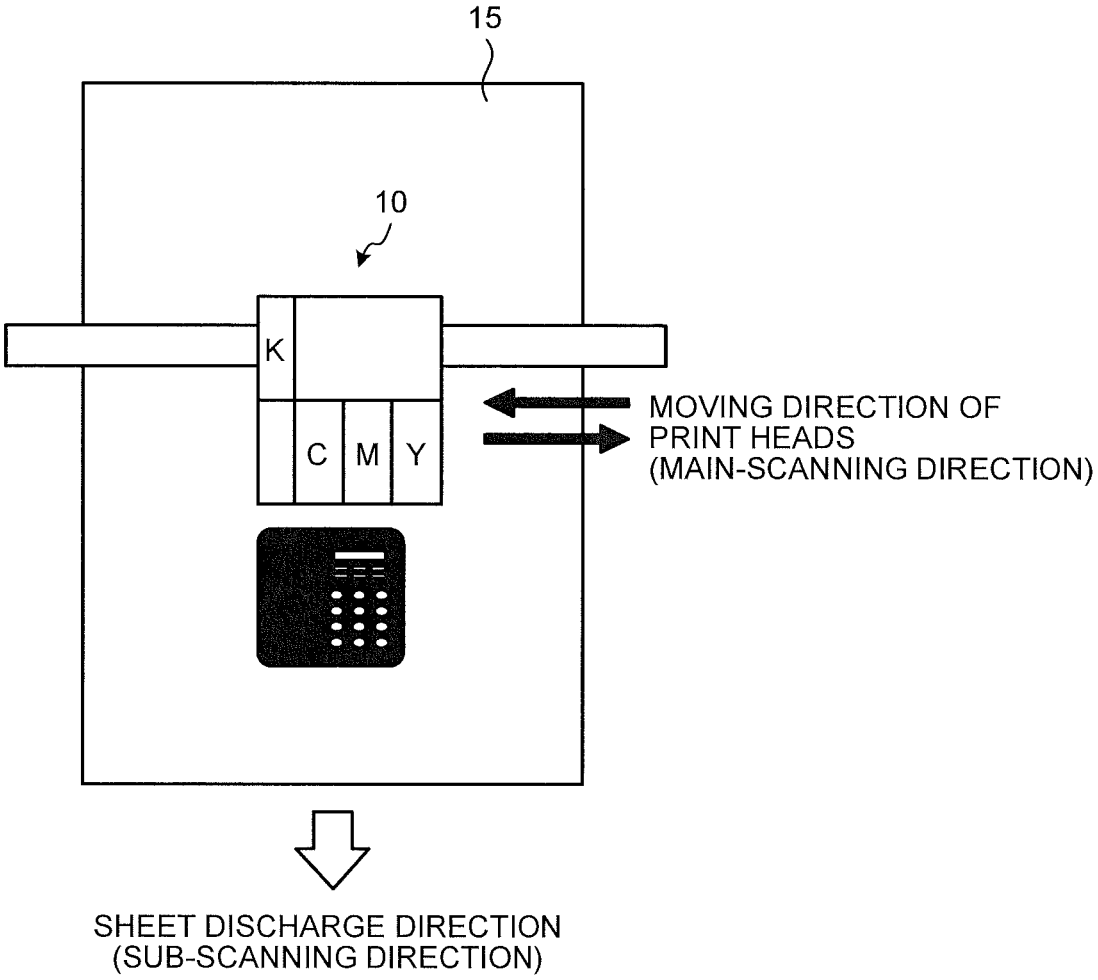
FIG. 4 is a diagram illustrating an example operation of the head unit during bi-directional recording onto a recording sheet.

FIG. 4 is a diagram illustrating an example operation of the head unit 10 during bi-directional recording onto the recording sheet 15. The ink ejection nozzles are arranged in an order of black, cyan, magenta, and yellow (hereinafter, "K, C, M, and Y") with respect to a forward, main-scanning recording direction. In addition, at positions downstream in the sub-scanning direction from these ink ejection nozzles, ink ejection nozzles for black are provided. The first embodiment is not intended to limit the order in which ink colors to be ejected from the head unit 10 are arranged or the number of the ink colors to those described above. A unit in which ink colors are arranged in a different order or which includes an additional color(s) can alternatively be employed depending on ink characteristics and/or design concept.

When bi-directional printing is performed, the head unit 10 according to the first embodiment does not use the print head 11 for black that is arranged in tandem with the print heads 12 and 13 for CMY but uses the print head 14 for black that is positioned downstream from the print heads 11 to 13 in the sub-scanning direction. More specifically, during forward recording in bi-directional printing, ink of cyan, magenta, and yellow is ejected onto a single spot in an order of C, M, and Y, and thereafter black ink is ejected onto the same spot. During backward printing in bi-direction printing, ink is ejected in the reversed order, or an order of Y, M, and C, and thereafter black ink is ejected. Why ejection is performed in this way is described below.

Coloring materials for inkjet printing have property related to fixation that when ink droplets of different colors are shot onto a single spot on a sheet, a color of an ink droplet that has reached the surface of the sheet earlier becomes dominant.

Figure 5:
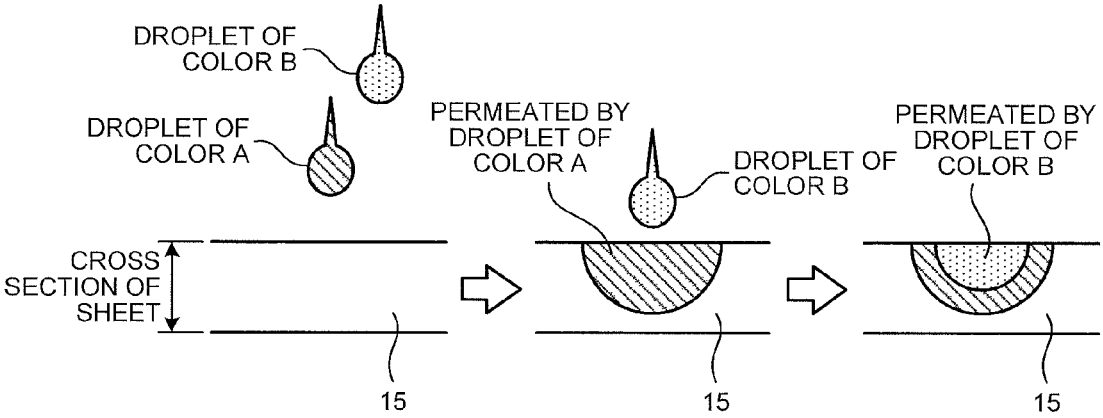
FIG. 5 is a cross-sectional view illustrating an example of coloring material distribution inside a recording sheet when dye ink is shot onto a same spot on the recording sheet.

FIG. 5 is a cross-sectional view illustrating an example of coloring material distribution inside the recording sheet 15 when dye ink is shot onto a same spot on the recording sheet 15. Ink shot earlier (in this example, a droplet of a color A) spreads in wider area than ink shot later (in this example, a droplet of a color B), resulting in a difference between fixation areas of the coloring materials. Accordingly, the color A becomes a dominant color component in a secondary color (e.g., C+M or M+Y).

Figure 6:
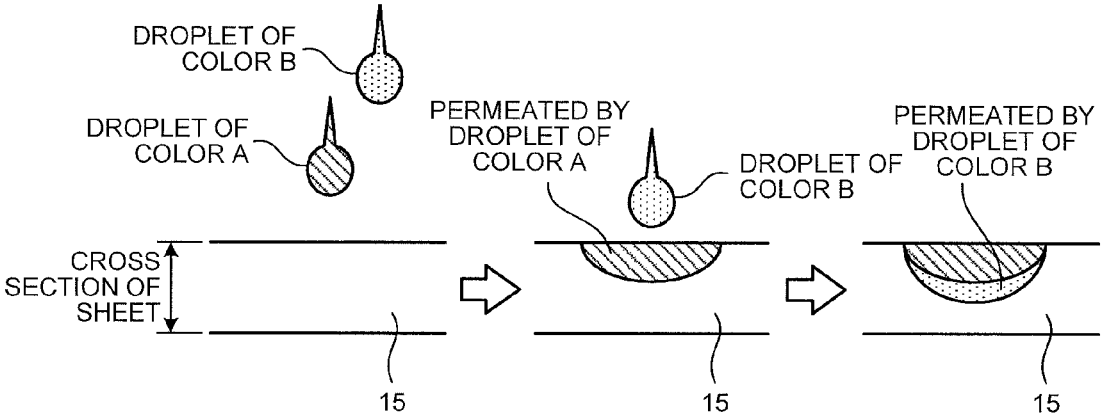
FIG. 6 is a cross-sectional view illustrating an example of coloring material distribution inside a recording sheet when pigmented ink is shot onto a same spot on the recording sheet.

FIG. 6 is a cross-sectional view illustrating an example of coloring material distribution inside the recording sheet 15 when pigmented ink is shot onto a same spot on the recording sheet 15. A coloring material in ink shot earlier (in this example, a droplet of the color A) stays on the surface of the sheet, while a coloring material of ink shot later (in this example, a droplet of the color B) has undesirably sunk into the sheet. As a result, the property of the coloring material on the recording surface of the recording sheet 15 is exhibited more pronouncedly, and the color A becomes a more dominant color component. This property related to fixation of coloring materials described above is likely to be exhibited more pronouncedly by pigmented ink used in the embodiments than dye ink.

When bi-directional recording is employed to increase print speed, it is necessary to take account of a change in color tone of a secondary color (e.g., C+M or M+Y) or a tertiary color (e.g., C+M+Y) caused by the property described above. The change in color tone may result in a horizontal banding pattern particularly in a case where a sheet is fed by a large distance for each of main-scanning forward strokes and main-scanning backward strokes.

Figure 7:
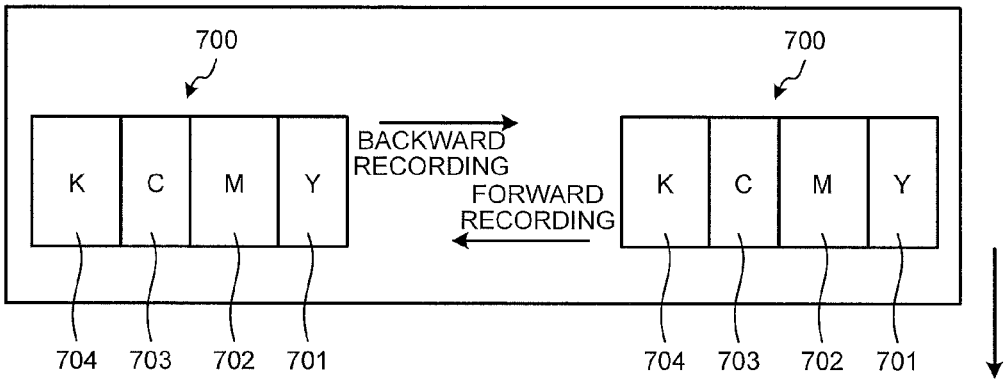
FIG. 7 is a diagram illustrating an example of arrangement of heads for different colors.

FIG. 7 is a diagram illustrating an example of arrangement of the heads for different colors, in other words, dominant-color/dominated-colors of conventional bi-directional recording. It is assumed that a head unit 700 illustrated in FIG. 7 includes a print head for each of the colors. As illustrated in FIG. 7, the head unit 700 includes a print head 701 for yellow (Y), a print head 702 for magenta (M), a print head 703 for cyan (C), and a print head 704 for black (K) arranged in this order from the right side. In an example illustrated in FIG. 7, the dominance relation among color components in secondary colors described above is shown. There is in an inverse relation in terms of dominance among the color components between a forward stroke and a backward stroke. As a matter of course, the degree of dominance varies depending on a recording sheet and composition of the ink. Predicted dominance relations among colors recorded by a forward stroke and a backward stroke are given below. Note that the relational expressions given below are simplified for convenience of description.

Predicted dominance relation among colors recorded by a forward stroke:

$$K>C>M>Y \tag{1}$$

Predicted dominance relation among colors recorded by a backward stroke:

$$Y>M>C>K \tag{2}$$

Figure 8:
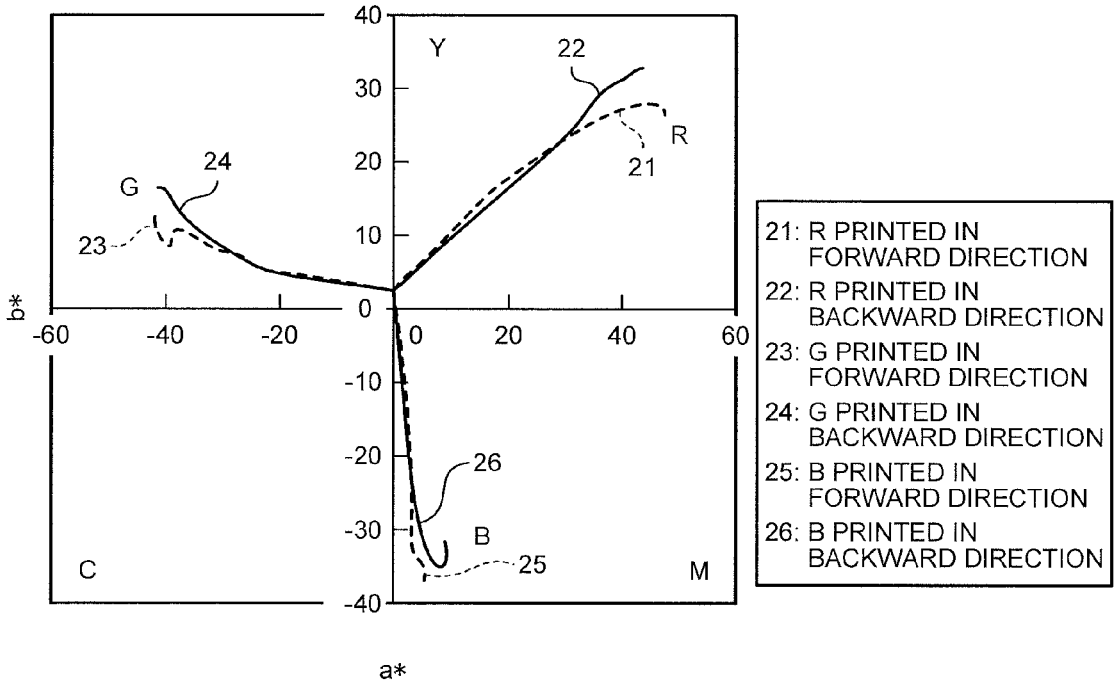
FIG. 8 is a chromaticity diagram illustrating an example of changes in hue resulting from different color printing orders pertaining to the conventional bi-directional recording.

FIG. 8 is a chromaticity diagram illustrating an example of changes in hue resulting from different color printing orders in conventional bi-directional recording. Characteristic curves 21 to 26 illustrated in FIG. 8 represent hues. More specifically, the characteristic curve 21 is a curve of red (R) printed in the forward direction, while the characteristic curve 22 is a curve of R printed in the backward direction. The characteristic curve 23 is a curve of green (G) printed in the forward direction, while the characteristic curve 24 is a curve of G printed in the backward direction. The characteristic curve 25 is a curve of blue (B) printed in the forward direction, while the characteristic curve 26 is a curve of B printed in the backward direction. As illustrated in FIG. 8, for example, a dominant color of red (the characteristic curve 21) recorded by a forward stroke and a dominant color of red (the characteristic curve 22) recorded by a backward stroke are interchanged, and red recorded by the backward stroke is yellowish. As for green, green recorded by a backward stroke (the characteristic curve 24) is also yellowish. As for blue, blue (the characteristic curve 26) recorded by a backward stroke is inclining to magenta. Results of prediction using the relations (1) and (2) are derived in this way.

Figure 9:
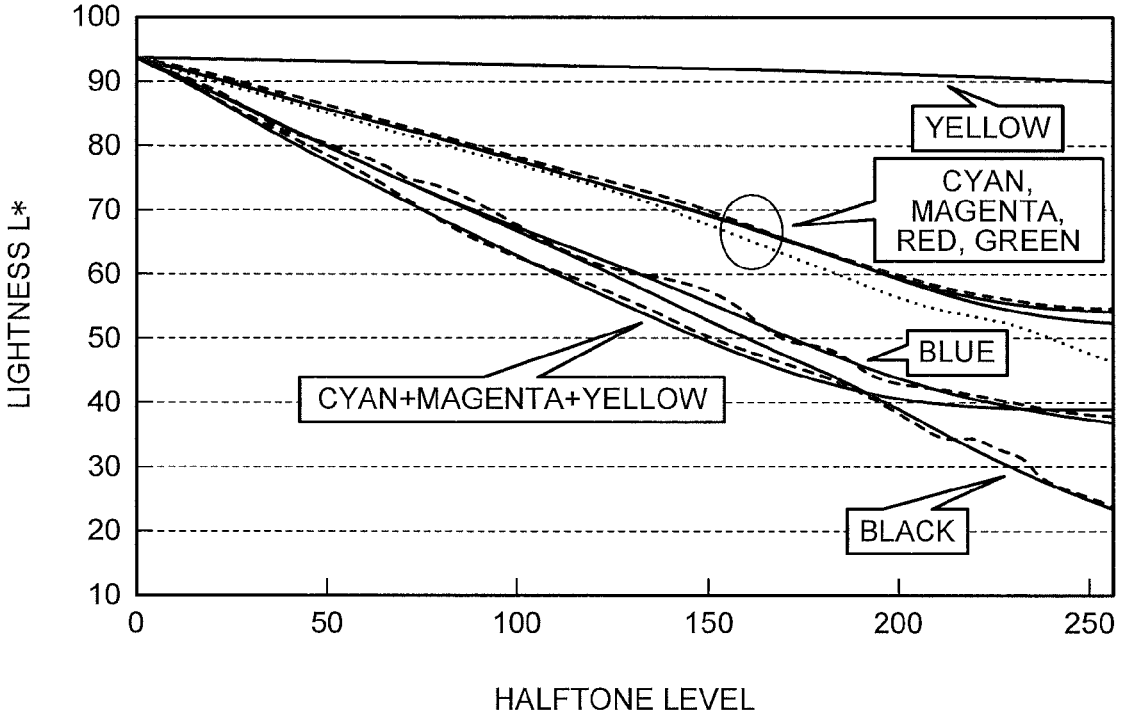
FIG. 9 is a diagram illustrating an example of a graph representing lightness reproduction ranges on a per-color basis.

FIG. 9 is a diagram illustrating an example of a graph representing lightness reproduction ranges on a per-color basis. Referring to this example, switching of a dominant color of, in particular, red and green to yellow not only results in a change in hue but also causes lightness to shift to higher values. In contrast, as for blue obtained by mixing cyan and magenta, difference between cyan and magenta in lightness is inherently small. Accordingly, even when a dominant color of blue is switched, a change in lightness is small and hence color difference resulting from the switching of the dominant color is less perceived than that of red or green. As a matter of course, such a tendency depends on an order in which the colors are arranged. In the example illustrated in FIG. 7, the head unit 10 has an arrangement of "K→C→M→Y" with respect to the forward direction; if the arrangement is "K→Y→M→C," a portion corresponding to yellow is replaced with cyan. Difference in hue between a forward stroke and a backward stroke is likely to become wider as lightness increases as described above.

In view of the circumstance, the head unit 10 of the inkjet recording apparatus 1 according to the first embodiment is configured such that black with lowest lightness is to be ejected after ink of C, M, and Y has been ejected on each of a forward stroke and a backward stroke.

The inkjet recording apparatus 1 according to the first embodiment has the configuration described below for the reason described above.

Figure 10:
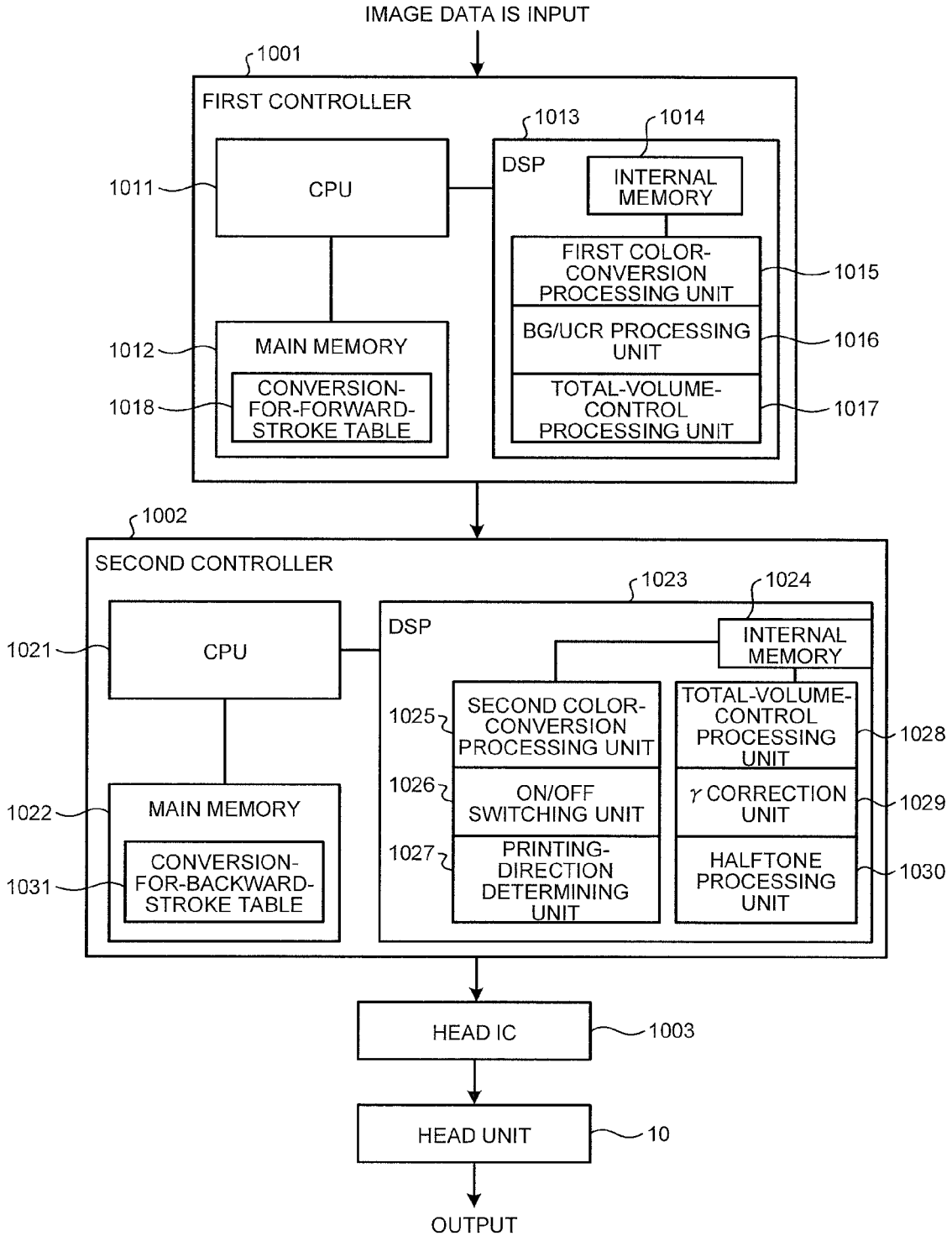
FIG. 10 is a diagram illustrating a hardware configuration of controllers of the inkjet recording apparatus according to the first embodiment.

FIG. 10 is a diagram illustrating a hardware configuration of controllers of the inkjet recording apparatus 1. As illustrated in FIG. 10, the inkjet recording apparatus 1 includes a first controller 1001, a second controller 1002, a head IC 1003, and the head unit 10.

The inkjet recording apparatus 1 according to the first embodiment switches between a color conversion process applied to forward recording and a color conversion process applied to backward recording, thereby lowering a change in color tone. It should be noted that bi-directional recording is a printing mode specially provided to increase a print speed, and one-way recording only in the forward direction is mainly performed in most instances. In consideration of this, the inkjet recording apparatus 1 is configured such that when bi-directional recording is set, a backward-recording-only color correction parameter that is adjusted with reference to a color correction parameter for forward recording, which serves as a reference, is applied only when backward recording is performed. Put another way, the inkjet recording apparatus 1 according to the first embodiment performs color conversion on image data using the first controller 1001, and, thereafter, performs color conversion again using the second controller 1002 only when backward recording is performed.

The first controller 1001 includes a central processing unit (CPU) 1011, main memory 1012, and a digital signal processor (DSP) 1013.

The CPU 1011 controls the overall first controller 1001. The main memory 1012 is used by the CPU 1011 and the DSP 1013 as a working area and a data storage area. The CPU 1011 reads out a conversion-for-forward-stroke table 1018 (this may alternatively be a conversion-for-backward-stroke table) stored in a storage section (not shown) and loads it into the main memory 1012 at startup of the inkjet recording apparatus 1.

The conversion-for-forward-stroke table 1018 is a three-dimensional lookup table (LUT) which is a 17×17×17 cube for use in converting image data of a RGB color system into image data of a CMY color system for a forward stroke.

The DSP 1013 includes internal memory 1014, a first color-conversion processing unit 1015, a black-generation/undercolor-removal (BG/UCR) processing unit 1016, and a total-volume-control processing unit 1017.

The internal memory 1014 is used as a working area for constituents of the DSP 1013. For instance, the internal memory 1014 is used as a storage area for temporarily storing image data when the first color-conversion processing unit 1015 performs color conversion.

The first color-conversion processing unit 1015 converts input image data of the RGB color system into image data of the CMY color system for use by the head unit 10 in performing forward printing. In the first embodiment, an example in which the first color-conversion processing unit 1015 performs the color conversion for the forward direction; alternatively, the first color-conversion processing unit 1015 may perform color conversion for the backward direction.

The BG/UCR processing unit 1016 performs black generation for and undercolor removal from the converted image data of the CMY color system, thereby generating image data of a CMYK color system.

In the first embodiment, the example in which the first color-conversion processing unit 1015 and the BG/UCR processing unit 1016 are used as a first color-conversion unit for generating image data for the forward direction is described; however, the configuration of the first color-conversion unit is not limited thereto.

The total-volume-control processing unit 1017 applies filtering to the generated CMYK image data on a color-by-color basis to prevent a to-be-used volume of the coloring material of each color from exceeding a total volume of the coloring material that can be output from the head unit 10 of the inkjet recording apparatus 1.

Meanwhile, application of the configuration of the first controller 1001 described above is not limited to inkjet recording apparatuses. The configuration is applicable to any image forming apparatus that prints CMYK image data. Put another way, the first controller 1001 is applicable not only to inkjet recording apparatuses but also various image processing apparatuses, such as laser printers, that perform printing using the CMYK color system. Therefore, cost can be reduced by economies of scale in manufacturing. The inkjet recording apparatus 1 according to the first embodiment causes the second controller 1002 to perform processing that is specific to inkjet printing.

The second controller 1002 includes a CPU 1021, main memory 1022, and a DSP 1023.

The CPU 1021 controls the overall second controller 1002. The main memory 1022 is used by the CPU 1021 and the DSP 1023 as a working area and a data storage area. The CPU 1021 reads out a conversion-for-backward-stroke table 1031 (when the first controller 1001 has read out the conversion-for-backward-stroke table, the conversion-for-forward-stroke table instead) stored in a storage unit (not shown) and loads it into the main memory 1022 at startup of the inkjet recording apparatus 1.

The conversion-for-backward-stroke table 1031 is a three-dimensional LUT which is a 16×16×16 cube for use in converting CMY image data for a forward stroke into CMY image data for a backward stroke. In the first embodiment, conversion for a backward stroke is performed by performing color conversion only on CMY excluding K from CMYK in this way.

The DSP 1023 includes internal memory 1024, a second color-conversion processing unit 1025, an on/off switching unit 1026, a printing-direction determining unit 1027, a total-volume-control processing unit 1028, a γ correction unit 1029, and a halftone processing unit 1030.

The internal memory 1024 is used as a working area for constituents of the DSP 1023. For instance, the internal memory 1024 is used as a storage area for temporarily storing image data when the second color-conversion processing section 1025 performs color conversion.

The second color-conversion processing unit 1025 converts the CMY image data, which is a part of the CMYK image data having been subjected to the conversion by the first color-conversion processing unit 1015 excluding data of black (K), into image data for use in printing in the backward direction (the direction opposite from the forward direction).

In the first embodiment, the first controller 1001 generates CMYK image data for a forward stroke from input image data. The second controller 1002 then performs color conversion for a backward stroke only on print lines for backward strokes. However, a considerably large storage area is required to perform color conversion on image data of the four colors (CMYK) generated by the first controller 1001.

In consideration of this, the inkjet recording apparatus 1 according to the first embodiment is configured such that only black (K) which is one of the four colors (CMYK) is ejected after the other colors (CMY) have been ejected on each of forward strokes and backward strokes. This makes it possible to lower a change in color tone of only black (K) caused by difference in color printing order between a forward stroke and a backward stroke.

In addition, the second color-conversion processing unit 1025 converts the CMY image data for the forward stroke into CMY image data for the backward stroke using the conversion-for-backward-stroke table 1031. This color conversion converts three colors and requires less memory. Thus, both reducing a storage capacity and lowering a change in hue can be achieved.

The printing-direction determining unit 1027 determines in which one of the forward direction or the backward direction the head unit 10 is to print a next print line.

The on/off switching unit 1026 switches between causing and not causing the second color-conversion processing unit 1025 to perform a second color conversion process on the CMYK image data having been subjected to conversion by the first color-conversion processing unit 1015 depending on which one of the forward stroke and the backward stroke has been determined by the printing-direction determining unit 1027.

The total-volume-control processing unit 1028 applies filtering to the generated CMYK image data on a color-by-color basis again to prevent a to-be-used volume of the coloring material of each color from exceeding the total volume of the coloring material that can be output from the head unit 10 of the inkjet recording apparatus 1.

The γ correction unit 1029 performs input and output correction on image data according to characteristics of the inkjet recording apparatus 1 and user preferences. This correction is referred to as γ correction. It is assumed that a γ parameter for use in the γ correction is stored in a storage unit (not shown) in advance.

The halftone processing unit 1030 performs a halftoning process that transposes image data into a pattern arrangement of dots to be ejected from the inkjet recording apparatus 1.

The head IC 1003 controls the head unit 10.

The inkjet recording apparatus 1 according to the first embodiment is configured as described above, and hence can eliminate difference in color tone between the forward direction and the backward direction in bi-directional recording.

The inkjet recording apparatus 1 according to the first embodiment corrects color tone through use of the color correction parameter. This is because no additional cost is required and also the color correction parameter can be easily established and modified. From a viewpoint of image processing, color tone can be corrected in a similar manner using a γ correction table, for example. However, correction using the γ correction table disadvantageously yields less correction effect on secondary or higher-level colors because correctable range of this scheme using the γ correction table is limited to primary colors. Although BG/UCR can handle multiple-level colors, only uniform correction can be performed by BG/UCR. Accordingly, it is difficult to correct color correction accurately all across the color gamut by BG/UCR. Under the circumstances, the inkjet recording apparatus 1 according to the first embodiment is configured such that after the first color-conversion processing unit 1015 has performed the color conversion for a forward stroke, the second color-conversion processing unit 1025 performs the color conversion for a backward stroke.

The inkjet recording apparatus 1 according to the first embodiment can simplify a color-difference correcting process by switching between correction parameters for use in correcting bi-directional color difference. Furthermore, the inkjet recording apparatus 1 causes color tone recorded by forward strokes to agree with color tone recorded by normal, one-way recording and adjusts a parameter for backward recording so that color tone recorded by backward recording becomes identical with the color tone recorded by forward recording. Accordingly, the inkjet recording apparatus 1 can lower difference between color tone recorded by bi-directional recording and color tone recorded by one-way recording which is a standard recording mode.

Figure 11:
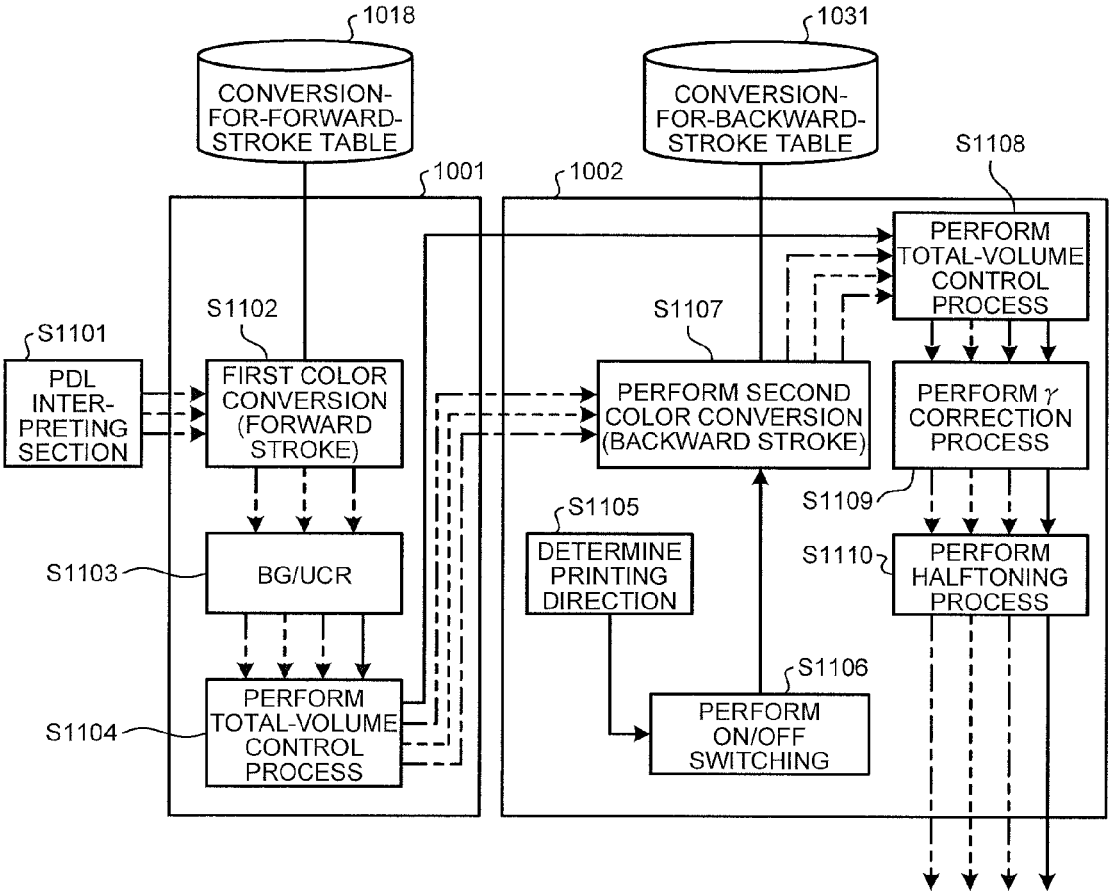
FIG. 11 is a diagram illustrating a flow of image data in the inkjet recording apparatus according to the first embodiment.

A flow of image data is described below. FIG. 11 is a diagram illustrating the flow of image data in the inkjet recording apparatus 1. As illustrated in FIG. 11, a page description language (PDL) interpreting unit 1101 converts input PDL intermediate data into RGB image data and outputs the RGB image data to the first controller 1001 (Step S1101).

The first color-conversion processing unit 1015 performs a first color conversion process, by which the RGB image data input to the first color-conversion processing unit 1015 is converted into CMY image data for forward printing (Step S1102). Thereafter, the BG/UCR processing unit 1016 performs black generation for and undercolor removal from the CMY image data, thereby generating CMYK image data (Step S1103).

Subsequently, the total-volume-control processing unit 1017 applies filtering to the generated CMYK image data on a color-by-color basis to prevent a to-be-used volume of the coloring material of each color from exceeding the total volume of the coloring material that can be output from the head unit 10 of the inkjet recording apparatus 1 (Step S1104).

Thereafter, when bi-directional printing is being performed, the printing-direction determining unit 1027 determines whether regions of the CMYK image data input to the second controller 1002 is to be printed in the forward direction or the backward direction on a per-region basis (Step S1105). Each of the regions corresponds to a width of a print line of the head unit 10.

The second color-conversion processing unit 1025 performs the second color conversion process only when the on/off switching unit 1026 has switched to cause the second color conversion process to be performed (Step S1106). By the second color conversion process, the image data for the three colors (CMY) excluding black (K) from the CMYK image data for the forward printing is converted into CMY image data for the backward printing (Step S1107).

Subsequently, the total-volume-control processing unit 1028 applies filtering to the CMYK image data on a color-by-color basis to prevent a to-be-used volume of the coloring material of each color from exceeding the total volume of the coloring material that can be output from the head unit 10 of the inkjet recording apparatus 1 (Step S1108).

Thereafter, the γ correction unit 1029 performs γ correction on the CMYK image data input to the γ correction section 1029 (Step S1109). Finally, the halftone processing unit 1030 performs the halftoning process on the CMYK image data (Step S1110).

The image data converted for the forward direction and the image data converted for the backward direction are output to the head unit 10 as a result of processing performed along the image data flow described above.

Figure 12:
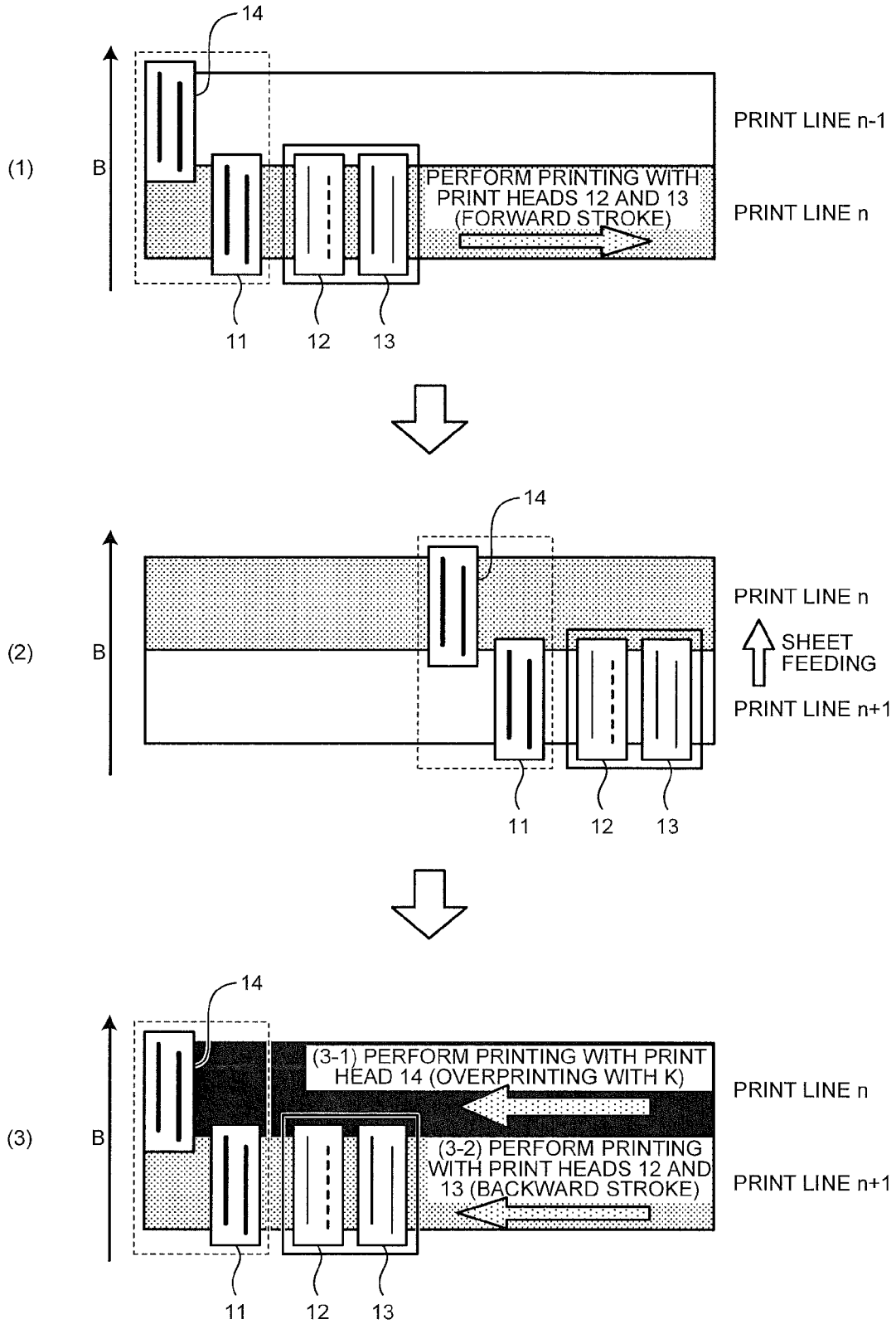
FIG. 12 is a diagram illustrating a procedure for a printing process to be performed by the head unit of the inkjet recording apparatus according to the first embodiment.

Printing performed by the head unit 10 of the inkjet recording apparatus 1 is described below. FIG. 12 is a diagram illustrating a procedure for the printing to be performed by the head unit 10 of the inkjet recording apparatus 1. FIG. 12 illustrates an example where a recording sheet is conveyed in the sub-scanning direction B. Illustrated in state (1) of FIG. 12 is printing performed in the forward direction. The head unit 10 performs printing on a print line n on the recording sheet in the forward direction using the print heads 12 and 13 that contain CMY coloring materials. During this printing, the print head 11 that contains a coloring material of black (K) is not used.

After completion of the printing on the print line n by the print heads 12 and 13, the recording sheet is conveyed in the sub-scanning direction B by sheet feeding as illustrated in state (2) of FIG. 12. When the recording sheet has thus been fed, a printing target of the print head 14 of the head unit 10 becomes the print line n, while a printing target of the print heads 12 and 13 becomes a print line n+1.

Thereafter, printing in the backward direction is performed as illustrated in state (3) of FIG. 12. The head unit 10 performs printing using the print head 14 on the print line n on which printing has already been performed by the print heads 12 and 13 that contain coloring materials of CMY as indicated by (3-1) of FIG. 12. Black (K) is overprinted using the print head 14 in this manner, causing black (K) to be printed last on both forward strokes and backward strokes. Accordingly, as for black (K), a change in color tone between the forward strokes and the backward strokes can be lowered.

Simultaneously with this printing with black indicated by (3-1) of FIG. 12, the head unit 10 performs printing on a print line n+1 on the recording sheet using the print heads 12 and 13 that contain the CMY coloring materials as indicated by (3-2) of FIG. 12. Meanwhile, color adjustment for the backward stroke has already been performed in the second color conversion process.

The second color conversion for the backward stroke is performed on CMY of CMYK, while K is overprinted in this manner, thereby lowering a change in color tone between forward strokes and backward strokes.

Figure 13:
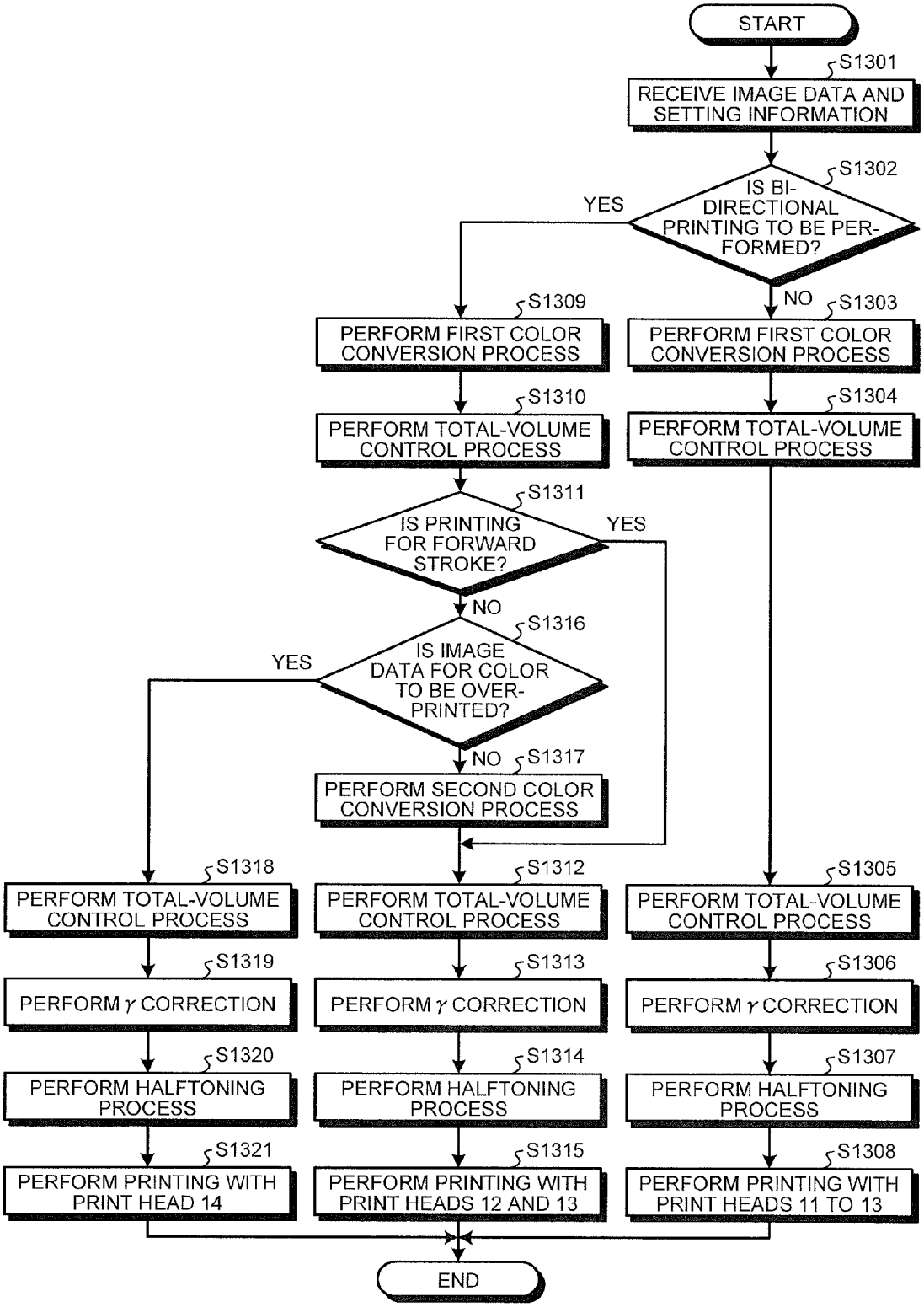
FIG. 13 is a flowchart illustrating a procedure for the printing process to be performed by the inkjet recording apparatus according to the first embodiment.

Next, a printing process to be performed by the inkjet recording apparatus 1 according to the first embodiment is described below. FIG. 13 is a flowchart illustrating a procedure for the printing process to be performed by the inkjet recording apparatus 1 according to the first embodiment.

First, the first controller 1001 receives RGB image data and setting information for printing that are input to the first controller 1001 (Step S1301). Subsequently, the CPU 1011 of the first controller 1001 determines whether bi-directional printing is to be performed based on the input setting information (Step S1302).

When the CPU 1011 determines that bi-directional printing is not to be performed (NO at Step S1302), the first color-conversion processing unit 1015 performs the first color conversion process, by which the RGB image data is converted into CMY image data (Step S1303).

Subsequently, the total-volume-control processing unit 1017 performs a total-volume control process on the CMYK image data having been subjected to the first color conversion process on a color-by-color basis (Step S1304).

When the image data is input to the second controller 1002, the total-volume-control processing unit 1028 of the second controller 1002 performs a total-volume control process on the CMYK image data on a color-by-color basis (Step S1305).

Thereafter, the γ correction unit 1029 performs γ correction on the CMYK image data (Step S1306). Subsequently, the halftone processing unit 1030 performs a halftoning process on the CMYK image data having been subjected to the γ correction (Step S1307).

The head unit 10 prints the CMYK image data using the print heads 11 to 13 (Step S1308).

When the CPU 1011 determines that bi-directional printing is to be performed (YES at Step S1302), the first color-conversion processing unit 1015 performs the first color conversion process, by which the RGB image data is converted into CMY image data (Step S1309). Thereafter, the total-volume-control processing unit 1017 performs the total-volume control process on the CMYK image data having been subjected to the first color conversion process on a color-by-color basis (Step S1310).

The printing-direction determining unit 1027 determines whether a printing direction is the forward direction (Step S1311). When the printing direction is determined as the forward direction (YES at Step S1311), the on/off switching unit 1026 performs switching so that the operations from the total-volume control process to the halftoning process are performed as in the case from Step S1305 to Step S1307 without the color conversion being performed by the second color-conversion processing unit 1025 (Step S1312 to Step S1314). Thereafter, the head unit 10 prints the CMY image data using the print heads 12 and 13 for CMY without using the print head 11 for black (Step S1315).

On the other hand, when the printing-direction determining unit 1027 determines that the printing direction is not the forward direction (NO at Step S1311), operations to be performed next are different depending on whether the image data is for a color to be overprinted, or, in other words, black (Step S1316). When the image data is for the colors other than black (NO at Step S1316), the on/off switching unit 1026 performs switching so that the second color-conversion processing unit 1025 performs the second color conversion process on the CMY image data excluding black (Step S1317). Thereafter, operations from the total-volume control process to the printing of the CMY image data using the print heads 12 and 13 for CMY are performed (Step S1312 to Step S1315).

On the other hand, when the image data is for black (YES at Step S1316), the operations from the total-volume control process to the halftoning process are performed as in the case from Step S1305 to Step S1307 while skipping the color conversion (Step S1318 to Step S1320). Thereafter, the head unit 10 prints the image data for black using the print head 14 for black (Step S1321).

As indicated at Step S1303 and Step S1309 of the process procedure described above, every region of every input image data is subjected to, as color processing for the forward direction, the color conversion process performed using the color conversion LUT for the forward direction.

Thereafter, the second color-conversion processing unit 1025 performs the color conversion on each region to be printed in the backward direction using the three-dimensional LUT for the backward direction at Step S1317. Lowering a change in color tone can thus be achieved.

The inkjet recording apparatus 1 according to the first embodiment is configured such that the first color conversion process and the second color conversion process are performed using the three-dimensional LUTs stored in advance. The first color conversion process and the second color conversion process may be configured to be changeable depending on a type of a recording medium on which printing is to be performed. Improvement in image quality can be achieved by performing color conversions adapted to the recording medium.

As for black, same values are to be used independently of the first color conversion process and the second color conversion process. However, it is not a necessary condition to use same values for black. Alternatively, a configuration in which a user can select whether to print black over CMY may be employed.

As described above, the second color-conversion processing unit 1025 performs the color conversion such that color conversion of one color (in the first embodiment, black) is not performed but the one color is printed over the other colors (CMY) to reduce the working area for use in the color conversion of image data. The reason why black is overprinted is that a color of low lightness is preferable as a overprinting color for the above-described reason. Lowering a change in color tone and improving image quality can be achieved by printing black last in this way.

The inkjet recording apparatus 1 according to the first embodiment is configured as described above. This configuration makes it possible to correct a color difference that can develop when different impacting orders of ink colors are used easily and effectively without additional cost nor scarifying print speed.

Meanwhile, there has been a growing trend in recent years to use inkjet recording apparatuses in offices where frequency of monochrome printing is high. Accordingly, importance is placed on increasing print speed and image quality of monochrome printing. In view of the circumstance, the inkjet recording apparatus 1 according to the first embodiment includes the print heads 11 and 14 for black so that regions that are twice as large as a region to be printed in monochrome printing are printed simultaneously, thereby increasing the print speed. Furthermore, each of the print heads 11 and 14 includes two rows of ejection nozzles arranged in the staggered pattern and therefore can perform printing at a doubled density. Accordingly, image quality can be increased.

It is further desirable that print speed of multiple-color printing can also be increased. To increase the print speed, the inkjet recording apparatus 1 according to the first embodiment performs bi-directional printing. The print head 14 provided for speed up of monochrome printing is used to perform printing after printing for CMY has been performed. This configuration makes only color conversion of CMY necessary for color conversion for backward strokes. Accordingly, the storage area necessary for the color conversion can be reduced while lowering a change in color tone.

It is further desirable that print speed of multiple-color printing can be increased. To increase the print speed, the inkjet recording apparatus 1 according to the first embodiment performs bi-directional printing. The print head 14 provided for speed up of monochrome printing is used to perform printing after CMY printing has been performed. This configuration narrows color conversion for backward strokes only to color conversion of CMY, thereby reducing the storage area required for the color conversion and also lowering a change in color tone.

Second Embodiment

In the first embodiment described above, the inkjet recording apparatus 1 performs the color conversions. However, the color conversions are not necessarily performed by the inkjet recording apparatus 1. Described below is a second embodiment of the present invention in which the color conversions are performed on a personal computer (PC) side connected to an inkjet recording apparatus.

Figure 14:
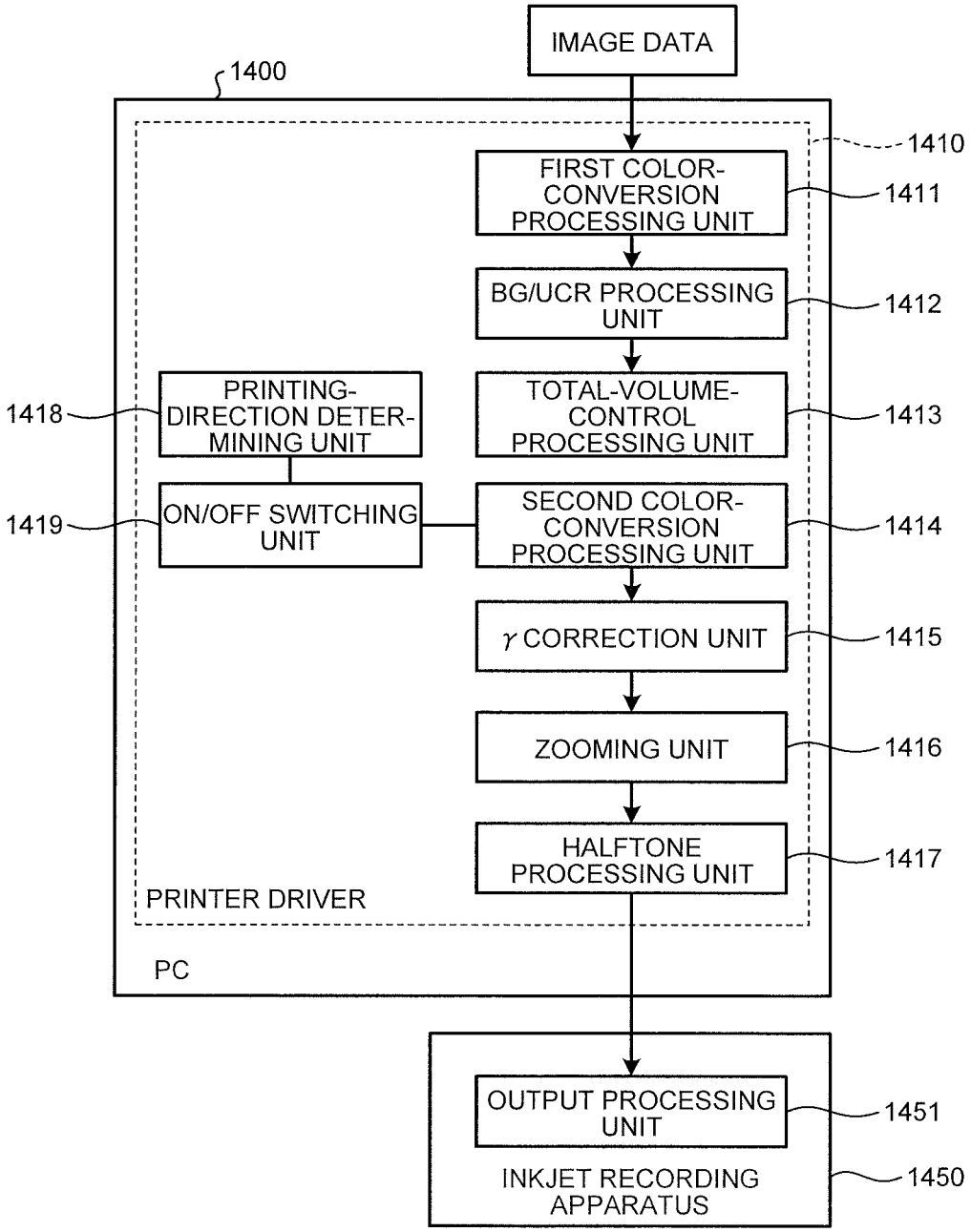
FIG. 14 is a diagram illustrating the configuration including an inkjet recording apparatus and a PC according to the second embodiment.

FIG. 14 is a diagram illustrating the configuration including an inkjet recording apparatus 1450 and a PC 1400 according to the second embodiment. As illustrated in FIG. 14, the PC 1400 executes a printer driver 1410 that includes a first color-conversion processing unit 1411, a BG/UCR processing unit 1412, a total-volume-control processing unit 1413, a second color-conversion processing unit 1414, a γ correction unit 1415, a zooming unit 1416, a halftone processing unit 1417, a printing-direction determining unit 1418, and an on/off switching unit 1419.

The inkjet recording apparatus 1450 includes an output processing unit 1451. The inkjet recording apparatus 1450 further includes the head unit 10 that is similar to that of the inkjet recording apparatus 1 according to the first embodiment and is capable of performing printing similar to that of the first embodiment.

The output processing unit 1451 performs printing of image data input from the PC 1400 using the head unit 10.

Constituents (the first color-conversion processing unit 1411, the BG/UCR processing unit 1412, the total-volume-control processing unit 1413, the second color-conversion processing unit 1414, the γ correction unit 1415, the halftone processing unit 1417, the printing-direction determining unit 1418, and the on/off switching unit 1419) of the printer driver 1410 perform operations similar to those performed by the first color-conversion processing unit 1015, the BG/UCR processing unit 1016, the total-volume-control processing unit 1017, the second color-conversion processing unit 1025, the γ correction unit 1029, the halftone processing unit 1030, the printing-direction determining unit 1027, and the on/off switching unit 1026 of the first embodiment, and repeated description is omitted. The zooming unit 1416 performs an enlarging process to conform to a resolution of the inkjet recording apparatus 1450. A procedure for processes to be performed by the PC 1400 and the inkjet recording apparatus 1450 according to the second embodiment is also similar to the procedure illustrated in FIG. 13, and repeated description is omitted.

The PC 1400 configured as described above can generate image data undergone the color conversion process appropriate for forward strokes and image data undergone the color conversion appropriate for backward strokes on a region-by-region basis of the print head and outputs the image data to the inkjet recording apparatus 1450 so that the inkjet recording apparatus 1450 can perform bi-directional printing.

A print instruction from application software executed on the PC 1400 side or the like is transmitted to the printer driver 1410. In response to the print instruction, the printer driver 1410 installed on the PC 1400 as software performs image processing. The image data is rasterized into to-be-recorded dot pattern data through the image processing, and thereafter transferred to the inkjet recording apparatus 1450.

The γ correction parameter is stored in a storage device such as a hard disk drive (not shown) in the PC 1400 when a configuration in which γ correction is performed by the printer driver 1410 on the PC 1400 side is employed as in the second embodiment. The PC 1400 according to the second embodiment also stores a three-dimensional LUT for the forward strokes and a three-dimensional LUT for the backward strokes that vary from each other in a storage section such as a hard disk drive (not shown). The printer driver 1410 has a function of selecting either one of the three-dimensional LUTs for use in processing image data transmitted to the head unit 10 depending on which one forward printing and backward printing is to be performed.

When image data appropriate for bi-directional printing is input from the PC 1400, the inkjet recording apparatus 1450 performs bi-directional printing of the image data as described above, thereby increasing print speed and lowering a change in color tone.

Third Embodiment

Having been described in the second embodiment is the one example embodiment in which the color conversions are performed on the PC side connected to the inkjet recording apparatus. The second embodiment is on an assumption that the inkjet recording apparatus is what is called as an inexpensive machine and deputes all image processing to the PC 1400 side. However, it is not requisite for the configuration in which the inkjet recording apparatus is connected to a PC to depute all image processing to the PC side. Described in a third embodiment of the present invention is an example embodiment using an inkjet recording apparatus that internally includes an application-specific integrated circuit (ASIC) 1553 that can perform a portion of the image processing.

Figure 15:
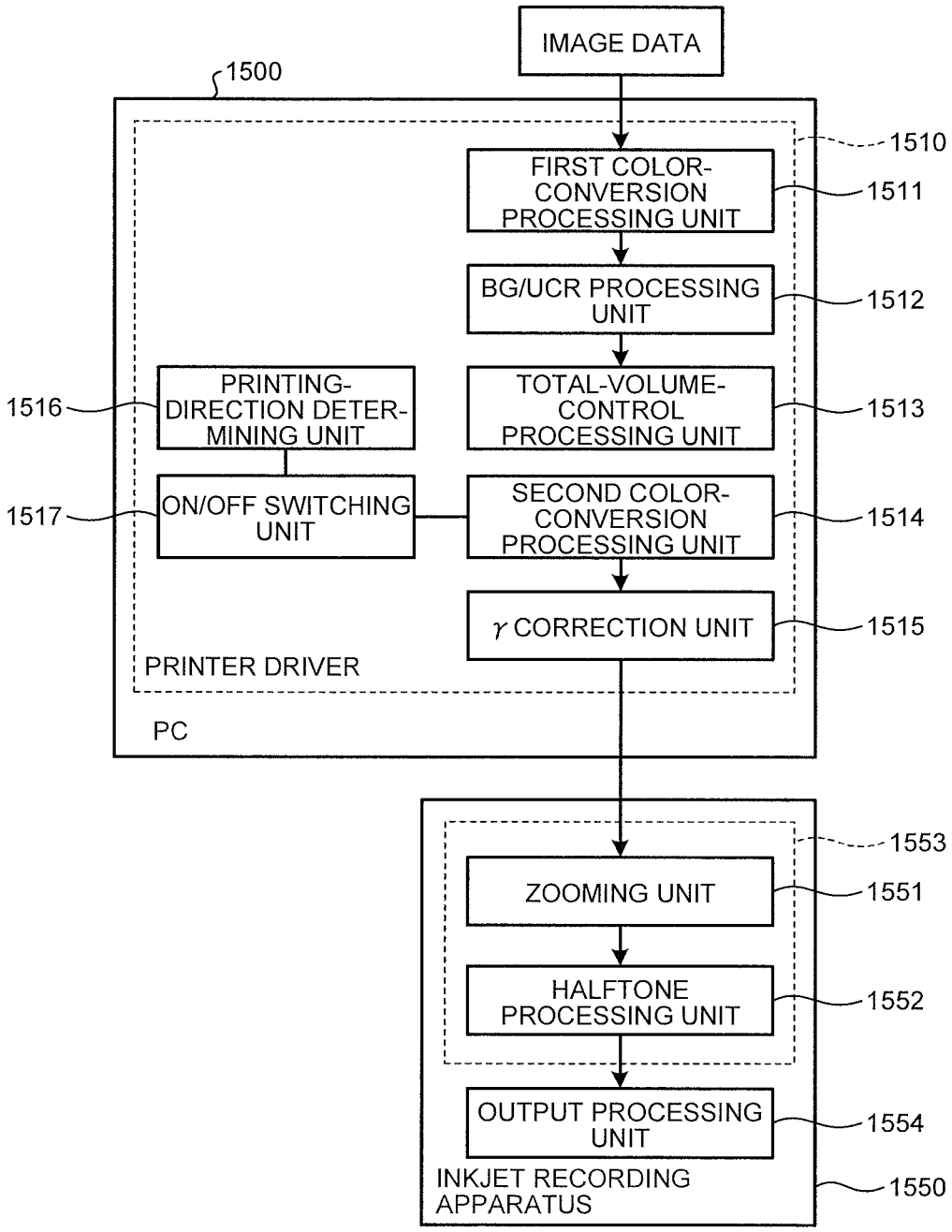
FIG. 15 is a diagram illustrating the configuration including an inkjet recording apparatus and a PC according to the third embodiment.

FIG. 15 is a diagram illustrating the configuration according to the third embodiment that includes an inkjet recording apparatus 1550 and a PC 1500. As illustrated in FIG. 15, the PC 1500 executes a printer driver 1510 that includes a first color-conversion processing unit 1511, a BG/UCR processing unit 1512, a total-volume-control processing unit 1513, a second color-conversion processing unit 1514, a γ correction unit 1515, a printing-direction determining unit 1516, and an on/off switching unit 1517.

The inkjet recording apparatus 1550 includes a zooming unit 1551, a halftone processing unit 1552, and an output processing unit 1554. The ASIC 1553 in the inkjet recording apparatus 1550 implements the zooming unit 1551 and the halftone processing unit 1552. The inkjet recording apparatus 1550 includes the head unit 10 that is similar to that of the inkjet recording apparatus 1 according to the first embodiment and is capable of performing printing similar to that of the first embodiment.

The third embodiment differs from the second embodiment in that some of constituents are provided on the inkjet recording apparatus rather than on the PC side. However, each of the constituents has a function similar to that of the second embodiment, and repeated description is omitted. A procedure for processes to be performed by the PC 1500 and the inkjet recording apparatus 1550 according to the third embodiment is also similar to the procedure illustrated in FIG. 13, and repeated description is omitted.

The PC 1500 configured as described above can generate image data having been subjected to the color conversion process appropriate for forward strokes and image data having been subjected to the color conversion appropriate for backward strokes on a region-by-region basis of the print head and outputs the image data to the inkjet recording apparatus 1550 so that the inkjet recording apparatus 1550 can perform bi-directional printing.

The inkjet recording apparatus 1550 and the PC 1500 configured in this way yield effects similar to those provided by the second embodiment. Furthermore, the third embodiment uses the inkjet recording apparatus 1550 that includes the ASIC 1553 that can perform zooming and halftoning. Accordingly, image processing can be performed in a manner shared between the PC 1500 side and the inkjet recording apparatus 1550, thereby reducing time required for the image processing and advancing timing of freeing the PC 1500 from the image processing.

The technique described above may be provided in a form of an image processing apparatus. Alternatively, the image processing described above may be implemented in an image recording apparatus. Alternatively, the technique may be provided in a form of a computer program.

First Modification

In the embodiments described above, the head unit of the inkjet recording apparatus includes two ink heads for black. However, the head unit does not necessarily have such a configuration. A modification of the head unit is described below.

Figure 16:
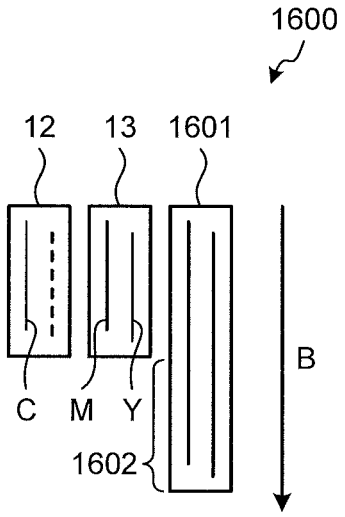
FIG. 16 illustrates an example of a head unit of an inkjet recording apparatus according to a first modification.

FIG. 16 illustrates an example of a head unit 1600 of an inkjet recording apparatus according to a first modification of the embodiments. The print heads 12 and 13 for CMY printing are similar to those of the embodiments described above. The head unit 1600 according to the first modification includes a print head 1601 for black.

Using the print head 1601 elongated in the sub-scanning direction B as shown in FIG. 16 makes it possible to print a wide area in monochrome printing, thereby achieving high-speed printing. In multiple-color printing, a region that has been printed with the print heads 12 and 13 for CMY printing is overprinted using only a portion 1602 of the print head 1601. The first modification configured as described above can yield an effect similar to that yielded by the embodiments.

Second Modification

Examples where black is overprinted after printing with CMY is completed have been described in the embodiments and the first modification. However, the color to be overprinted is not limited to one color. An example in which two colors are overprinted is described as a second modification. It should be noted that although two colors are overprinted in the second modification, three or more colors may be overprinted.

Figure 17:
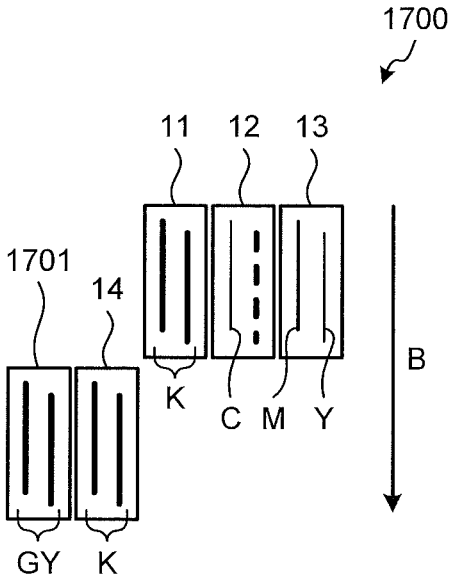
FIG. 17 illustrates an example of a head unit of an inkjet recording apparatus according to a second modification.

FIG. 17 illustrates an example of a head unit 1700 of an inkjet recording apparatus according to the second modification. The print heads 11 to 14 are similar to those of the embodiments described above. The head unit 1700 according to the second modification further includes a print head 1701 for gray (GY).

Gray and black differ from each other only in lightness. Accordingly, even when the print heads for black and gray are arranged in tandem in the main-scanning direction, a change in color tone between a forward stroke and a backward stroke will not occur. An effect similar to that yielded by the embodiments can be yielded even when the number of colors to be overprinted is not limited to one but two or more colors are overprinted.

The printer driver to be executed by the PCs of the second and third embodiments can be provided as being recorded in a computer-readable recording medium such as a compact-disk read-only memory (CD-ROM), a flexible disk (FD), a CD-recordable (CD-R), or a digital versatile disk (DVD) in an installable or executable format.

The printer driver to be executed by the PCs of the second and third embodiments may be configured to be stored in a computer connected to a network such as the Internet so that the printer driver is provided by downloading via the network. The printer driver to be executed by the PCs of the embodiments may be configured to be provided or distributed via the network such as the Internet.

According to the present invention, printouts can be output in appropriate hue without sacrificing print speed and with reduced additional cost.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a plurality of print heads that eject ink droplets of a plurality of coloring materials from nozzles thereof onto a recording sheet conveyed by a conveying unit while reciprocatingly moving in a main-scanning direction perpendicular to a conveying direction of the recording sheet, the plurality of print heads including a first print head for a first coloring material among the plurality of coloring materials and second print heads for other coloring materials among the plurality of coloring materials, the first print head and the second print heads being arranged in the main-scanning direction, the first print head being arranged to eject the first coloring material after the second print heads eject the respective other coloring materials in each of a forward stroke and a backward stroke in bi-directional printing; and one or more controllers, the one or more controllers being configured to, perform a first color-conversion processing operation that includes generating first image data by converting input image data of a first color system into image data of a second color system different from the first color system, and perform a second color-conversion processing operation that includes converting partial image data into second image data for use in printing in any one direction of the forward stroke and the backward stroke, the partial image data being image data which is obtained by excluding image data for the first coloring material from the first image data, the one or more controllers being configured to control the plurality of print heads such that, when performing printing in a direction opposite from the one direction, the first print head ejects ink droplets of the first coloring material based on the first image data, and the second print heads eject ink droplets of the other coloring materials based on the first image data, and when performing printing in the one direction, the first print head ejects ink droplets of the first coloring material based on the first image data, and the second print heads eject ink droplets of the other coloring materials based on the second image data.

2. The image forming apparatus according to claim 1, wherein the first coloring material is lowest in lightness among the plurality of coloring materials.

3. The image forming apparatus according to claim 1, wherein at least two print heads of the plurality of print heads are for the first coloring material, and one print head of the at least two print heads is arranged in tandem with the second print heads in the main-scanning direction, while the other print head of the at least two print heads is deviated from the second print heads in a sub-scanning direction in which the recording sheet is conveyed by the conveying unit.

4. The image forming apparatus according to claim 1, wherein the first print head is longer than the second print heads in a sub-scanning direction in which the recording sheet is conveyed by the conveying unit.

5. The image forming apparatus according to claim 1, further comprising:

a print head for a second coloring material other than the first coloring material, which is arranged such that the second coloring material is to be ejected later than the other coloring materials.

6. The image forming apparatus according to claim 1, wherein the first color-conversion processing operation includes converting RGB image data as the input image data into CMY image data and performing black generation and undercolor removal on the CMY image data, thereby obtaining CMYK image data as the first image data.

7. A computer program product comprising a non-transitory computer-readable medium including programmed instructions, wherein the instructions, when executed by a computer that transmits image data to an image forming apparatus including a plurality of print heads that eject ink droplets of a plurality of coloring materials from nozzles thereof onto a recording sheet conveyed by a conveying unit while reciprocatingly moving in a main-scanning direction perpendicular to a conveying direction of the recording sheet, the plurality of print heads including a first print head for a first coloring material among the plurality of coloring materials and second print heads for other coloring materials among the plurality of coloring materials, the first print head and the second print heads being arranged in the main-scanning direction, the first print head being arranged to eject the first coloring material after the second print heads eject the respective other coloring materials in each of a forward stroke and a backward stroke in bi-directional printing, cause the computer to execute:

performing a first color-conversion processing operation that includes generating first image data by converting input image data of a first color system into image data of a second color system different from the first color system, performing a second color-conversion processing operation that includes converting partial image data into second image data for use in printing in any one direction of the forward stroke and the backward stroke, the partial image data being image data which is obtained by excluding image data for the first coloring material from the first image data, and controlling the plurality of print heads such that, when performing printing in a direction opposite from the one direction, the first print head ejects ink droplets of the first coloring material based on the first image data, and the second print heads eject ink droplets of the other coloring materials based on the first image data, and when performing printing in the one direction, the first print head ejects ink droplets of the first coloring material based on the first image data, and the second print heads eject ink droplets of the other coloring materials based on the second image data.

* * * * *